United States Patent [19]

Martin et al.

[11] Patent Number: 4,798,316

[45] Date of Patent: Jan. 17, 1989

[54] SHEET STORE

[75] Inventors: Harvey G. Martin, West Sussex; Roger Pilling; Steven M. Hosking, both of Hampshire, all of England

[73] Assignee: De La Rue Systems, Limited, England

[21] Appl. No.: 106,103

[22] Filed: Oct. 7, 1987

[30] Foreign Application Priority Data

| | | | |
|---|---|---|---|
| Oct. 8, 1986 | [GB] | United Kingdom | 8624192 |
| Jan. 13, 1987 | [GB] | United Kingdom | 8700704 |
| Jan. 21, 1987 | [GB] | United Kingdom | 8701253 |

[51] Int. Cl.[4] ..... B65D 91/00

[52] U.S. Cl. ..... 232/43.1; 232/1 D; 271/127; 271/160

[58] Field of Search ..... 211/51; 232/10, 43.2, 232/43.1; 312/50; 271/126, 127, 160; 235/379

[56] References Cited

U.S. PATENT DOCUMENTS

| | | | |
|---|---|---|---|
| 3,127,225 | 3/1964 | Oehrlein | 312/50 |
| 4,007,925 | 2/1977 | DePyke et al. | 271/126 X |
| 4,219,192 | 8/1980 | Burke | 271/127 X |
| 4,269,407 | 5/1981 | Tsuda et al. | 271/127 |
| 4,358,102 | 11/1982 | Hoshizaki et al. | 271/126 X |

*Primary Examiner*—Robert W. Gibson, Jr.

*Attorney, Agent, or Firm*—Ostrolenk, Faber, Gerb & Soffen

[57] ABSTRACT

A sheet store, particularly for banknotes, comprises a container having an opening through which sheets can pass closed by a shutter. A pressure member is positioned in the container. The pressure member is biassed by two springs connected in series. A clamp is provided selectively to restrain the influence of one spring allowing two bias forces to be applied to the pressure member.

12 Claims, 9 Drawing Sheets

SHEET STORE

FIELD OF THE INVENTION

The invention relates to sheet stores, for example cassettes for storing banknotes.

DESCRIPTION OF THE PRIOR ART

For many years, cash dispensers have been built for dispensing quantities of banknotes either to bank tellers or directly to customers. Typically, sets of banknotes of particular denominations are stored in respective cassettes loaded into the dispenser which then selectively removes the correct quantity of banknotes from the cassettes in response to operator commands. Once a cassette has been emptied it must be removed and replaced by a newly filled cassette. Typically, the replacement cassette will have been filled in another building and then have been transported to the cash dispenser leading to the risk of losing the cassette or of the cassette being stolen.

More recently, cash acceptors have been developed allowing bank customers to deposit sums of money in the form of banknotes. In typical cash acceptors, the banknotes fed into the acceptor are validated and then fed into respective stores depending upon their denomination. These stores also comprise cassettes having a similar form to the cash dispenser cassettes. Once a cassette is full it is removed from the acceptor and returned to the bank where the banknotes are unloaded and the empty cassette is returned to the cash acceptor.

Typical cassettes comprise a container having an opening through which sheets such as banknotes can pass; a pressure member in the container; and biasing means causing the pressure member to urge sheets in the container towards the opening. Different types of cassette have been developed for use with cash dispensers and cash acceptors. In a cash acceptor it is important for the pressure member to be urged under a comparatively large force towards the opening to assist in forcing banknotes into the cassette. In cash dispensers, however, it is important for individual banknotes to be slid out of the cassette in which case a relatively light loading of the stack of notes in the cassette is required. In addition, typical cash acceptor cassettes are mounted vertically with the pressure member being forced in an upward direction so that the biasing means must overcome gravity while in cash dispensers cassettes are typically mounted horizontally.

These different requirements have led to the development of two different types of cassette which leads to relatively large expense in view of the amount of tooling required for the manufacture and a lack of flexibility since cassettes can only be used with a cash dispenser or an acceptor.

SUMMARY OF THE INVENTION

To deal with this problem and in accordance with the present invention, a sheet store comprises a container having an opening through which sheets can pass; a pressure member in the container; biasing means, the biasing means causing the pressure member to urge sheets in the container towards the opening and being adapted to apply one of two bias forces; and control means to control the bias force applied by the biasing means.

This invention provides a sheet store, for example a banknote cassette, in which the pressure member may be urged towards the opening under one of two bias forces. This enables the store to be used as a cassette for both cash dispensers and cash acceptors simply by applying the correct bias force under control of the control means.

It should be understood that although the invention is particularly applicable to banknote cassettes, it may also be used with stores for other documents, particularly security documents.

One of the major advantages of the invention is that the sheet store may be used in a sheet dispensing and receiving system comprising a sheet dispenser and sheet receiver. Typically, these will be positioned adjacent one another or at least in the same building so that stores which have been filled in a sheet receiver can be directly transferred to a sheet dispenser for dispensing the same sheets. This has particular application in cash dispensing and receiving systems by reducing the risk of loss and lack of security.

In one example, the biasing means comprises a first biasing member permanently urged against the pressure member; and a second biasing member selectively urged against the pressure member under control of the control means.

In the preferred arrangement, the biasing means comprises first and second bias portions connected in series, the first bias portion being coupled with the pressure member and the second bias portion being anchored to the container, the control means being adapted selectively to isolate the pressure member from the effect of the second bias portion. This arrangement leads to a more simplified construction than the first example with the two bias forces being generated respectively by the first bias portion and the first and second bias portions together. In practice, if the spring constants are significantly different, the second bias will be due primarily to the second bias portion alone.

Preferably, in this example, the control means comprises a clamp which is selectively actuable to anchor part of the first bias portion remote from the pressure member and thereby to isolate the pressure member from the effect of the second bias portion.

Conveniently, the clamp is pivoted to the container and has an arm for actuation by an operating member of a housing into which the store is located.

Typically, the first and second bias portions comprise springs (either tension or compression). Conveniently, the springs are coupled together by the coupling member which is selectively engaged by the control means to prevent it from moving and thereby to isolate the spring comprising the first bias portion from the other spring.

The store may further comprise a a closure assembly including a shutter for closing the opening, and a locking device for locking the shutter in its closed position, the control means being actuable in one mode to maintain the locking device in a locked position and to cause one of the two bias forces to be applied to the pressure member and in another mode to release the locking device and to cause the other of the two bias forces to be applied to the pressure member.

BRIEF DESCRIPTION OF THE DRAWINGS

An example of a banknote cassette in accordance with the present invention will now be described with reference to the accompanying drawings, in which.

DETAILED DESCRIPTION OF AN EMBODIMENT

Figure 1:
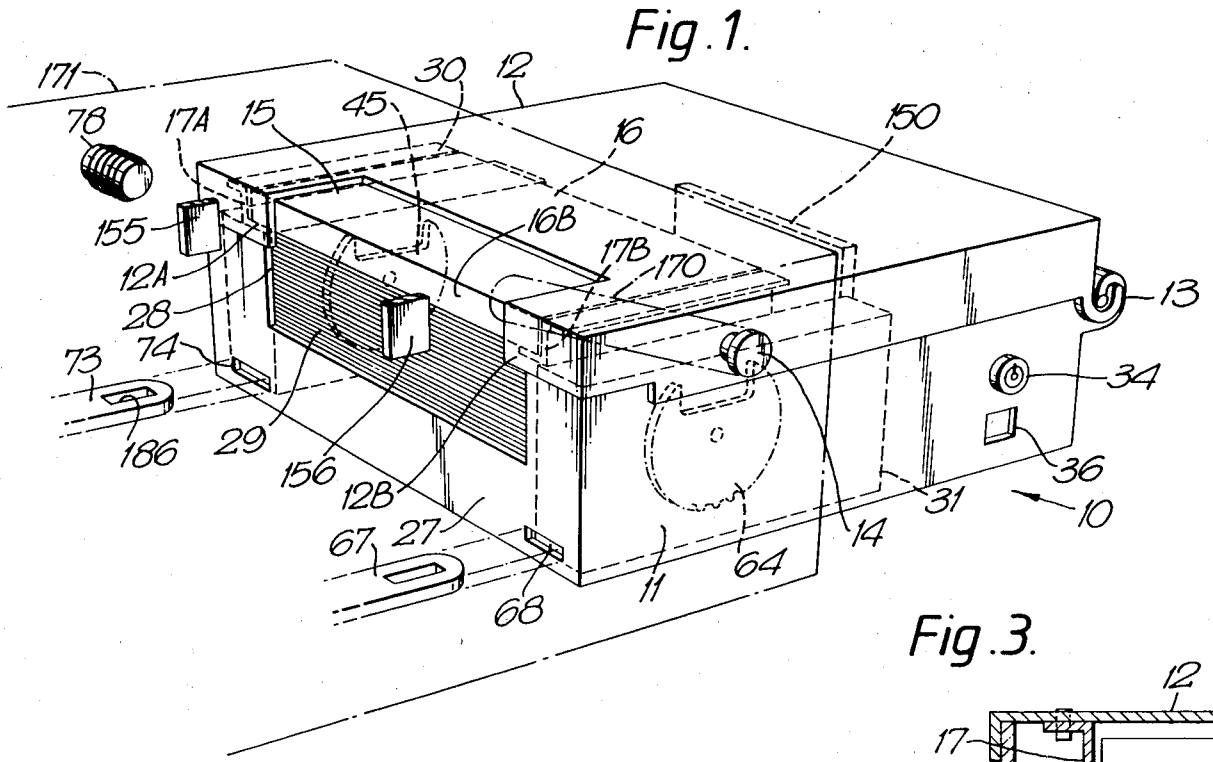
FIG. 1 is a schematic, perspective view of the cassette, and part of a cassette housing.

FIG. 1 illustrates a banknote cassette 10 which can be used in either a cash accepting mode or a cash dispensing mode. FIG. 1 also illustrates parts of cash dispensing apparatus.

The cassette 10 comprises an outer casing 11 having a lid 12 hinged to the casing 11 at 13. The lid 12 is arranged to be swung open by means of a slot 170 in the cassette housing of a cash dispenser along which slides a cam 14 fixed to the lid 12. The slot 170 extends at an angle to the direction of insertion of the cassette 10 into the housing.

The lid 12 is cut away at its leading end to form an aperture 15 of rectangular form. The aperture 15 is closed by an upper shutter 16 made of tough plastics material which is slidably mounted to the lid.

Figure 2A:
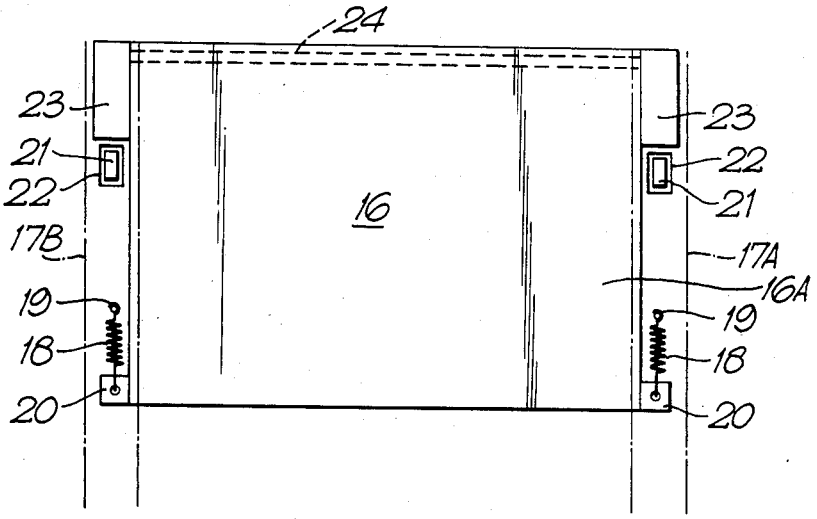
FIG. 2A is a plan of the upper shutter.

The shutter 16 is shown in more detail in FIG. 2A. The upper shutter 16 comprises a planar section 16A having a pair of laterally extending abutments 23 at its forward end and a pair of laterally extending wings 20 at its rearward end, each wing 20 having an aperture which receives one end of a respective tension spring 18. As can be seen in FIG. 1, the forward end of the shutter 16 has a depending skirt 16B.

Figure 2B:
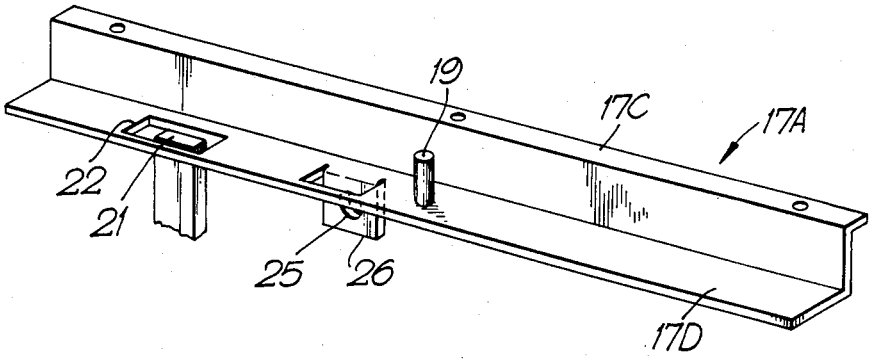
FIG. 2B illustrates one of the rails along which the upper shutter slides.

The upper shutter 16 is slidably mounted between a pair of L-shaped rails 17A, 17B, the rail 17A being shown in more detail in FIG. 2B. The rails 17A, 17B are mounted to the underside of the lid 12 via respective flanges 17C. Each rail 17A, 17B has a lower flange section 17D on which is fixed an upwardly extending pin 19. In addition, each rail 17A, 17B has an aperture 22 positioned forwardly of the pin 19.

The upper shutter 16 rests on the laterally extending portions 17D of the rails with the free ends of the tension springs 18 connected to respective pins 19 as shown in FIG. 2A. Thus, the upper shutter 16 is urged in the forward direction to the closed position shown in FIG. 1 by the springs 18. In this forward position, the skirt 16B of the upper shutter abuts against the front flange portions 12A, 12B of the lid 12.

The upper shutter 16 is prevented from moving in a rearward direction by a pair of stop members 21 which, in a locked position, protrude through the apertures 22 in the rails 17A, 17B and abut against the adjacent abutments 23. The operation of the stop members 21 will be explained in more detail below.

A pair of control assemblies 30, 31 are provided on opposite side walls 12, 11 of the cassette. The control assembly 31 constitutes a tamper-proof assembly and is shown in more detail in FIGS. 4A–4C. This assembly comprises a plastics moulding 31A having a slide member 32 which is moved to and fro within a slot 32A by a lever shown diagram- matically at 33. The position of the lever 33 is controlled by a key operated lock 34 (FIG. 1), details of the lock being omitted from FIG. 4A, for clarity.

Figure 4A:
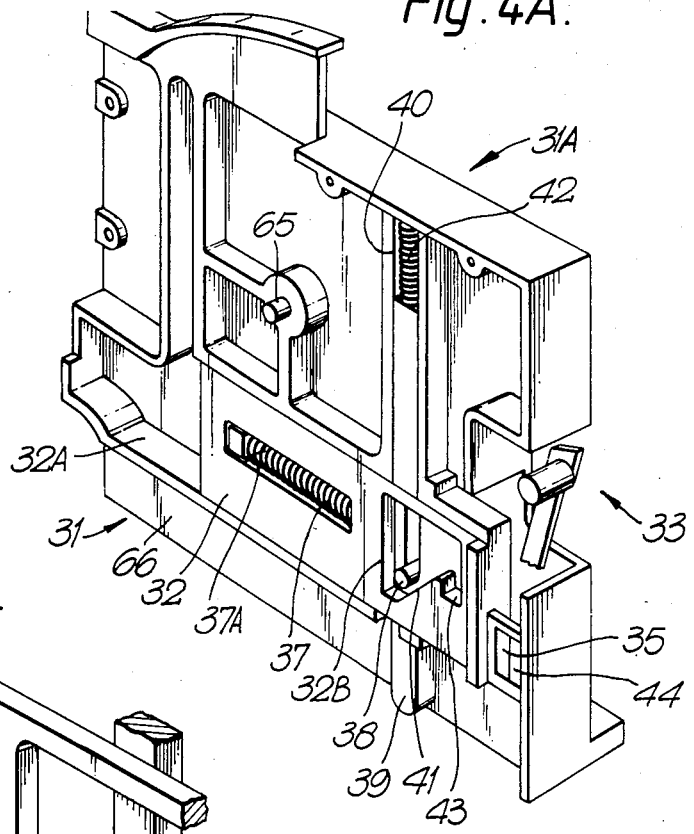
FIG. 4A is a perspective view of the tamper-proof control assembly with some parts omitted for clarity.

In the position shown in FIG. 4A, the cassette is in the locked condition with a red indicator 35 being visible through a window 36 in the side wall 11. Clockwise movement of the key (as viewed in FIG. 1) will move the lever 33 so that the slide member 32 will move to the left, as seen in FIG. 4A, against the force of a compression spring 37 connected between one end of slot 37A in the slide member 32 and part of the plastics moulding 31A. A locking member 39 is slidably mounted in a vertical slot 40 of the moulding 31A and is urged in a downward direction by a compression spring 42 provided in the slot 40. The locking member 39 carries laterally extending pin 38 which is positioned within an aperture 32B of the slide member 32. The lower, inner surface of the aperture 32B includes a ramp section 41 and a notch 43.

It will be seen from FIG. 4A that movement of the slide member 32 to the left under the control of the key operated lock, will cause the pin 38 to ride up the ramp 41 thus drawing the locking member 39 in an upwards direction. This movement will continue until the pin 38 drops into the notch 43 at which point the cassette is in a "primed" condition. This movement of the slide member 32 will bring a green flag 44 into line with the window 36.

In addition to the components shown in FIG. 4A, the control assembly also includes a rack and pinion assembly comprising a rack 63 (FIGS. 4B, 4C) and a pinion 64 (FIG. 1) with toothed segments mounted on a spindle 65. The teeth of the pinion 64 engage the teeth of the rack 63. The rack 63 also includes an upstanding flange section 65 having at its leading end a cam surface 73A. The lower end of the locking member 39 engages the upper surface of the flange 65, the rack 63 being slidable along a groove 66 of the moulding 31A. The rack 63 is locked to the moulding 31A in a manner (not shown) similar to the manner in which a rack 70 is locked to a moulding 48, described below.

Figure 4B:
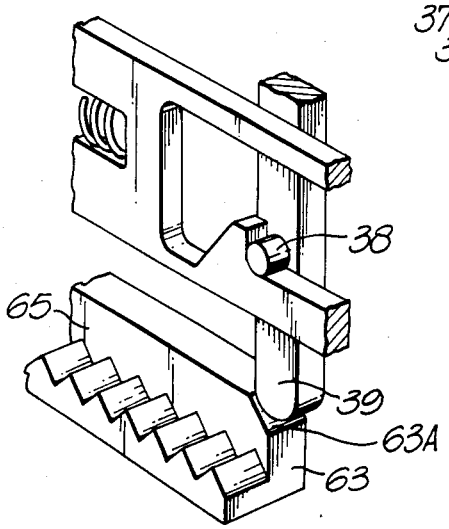
FIGS. 4B and 4C illustrate part of the tamper-proof assembly in different positions.
Figure 4C:
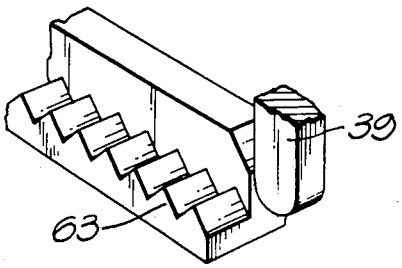

The operation of the tamper-proof assembly 31 is as follows. When the cassette is inserted into a cassette housing of a cash dispenser or cash acceptor, a probe 67 fixed to the housing enters into a slot 68 in the leading end of the cassette. This slot communicates with the slot 66 so that the probe 67 locks with and pushes the rack 63 in a rearward direction, as seen in FIG. 1. The locking of the probe 67 to the rack 63 is similar to the locking of a probe 73 to the rack 70. Just prior to insertion of the cassette, the tamper-proof assembly will have been primed with the pin 38 located in the notch 43, as seen in FIG. 4B. Movement of the rack 63 in response to insertion of the cassette into the cassette housing, will cause the lower end of the locking member 39 to rise up, dis-engaging the pin 38 from the notch 43. This disengagement will allow the slide member 32 to spring back to the position shown in FIG. 4A under the influence of the compression spring 37 and bring the red flag 35 into view through the aperture 36. Whilst the cassette remains in the cassette housing, the locking member 39 will remain in its present position, but when the cassette is withdrawn, the probe 67 will draw the rack 63 back to its initial position so that the lower end of the locking member 39 will ride back across the cam surface 63A and then drop down behind the rack 63 as shown in FIG. 4C. In this position, it will no longer be possible for a probe to push the rack 63 along the slot 66, thus preventing the cassette from being inserted into another housing.

The purpose of this tamper-proof assembly 31 is to allow the cassette only to be opened by a key holder. Any attempt to tamper with the cassette in its primed condition, will cause the locking mechanism to trip to the position shown in FIG. 4A so that the red indicator 35 is visible through the window 36 signifying that tampering has taken place. It is impossible to reset the "red" indication without a key.

Prevention of the cassette from being opened is achieved indirectly by the control assembly 31 since by preventing the probe 67 from moving the rack 63 along the slot 66 a similar operation is prevented from occurring in the control assembly 30 to be described below. It is the control assembly 30 which controls opening and closing of the cassette.

Figure 3:
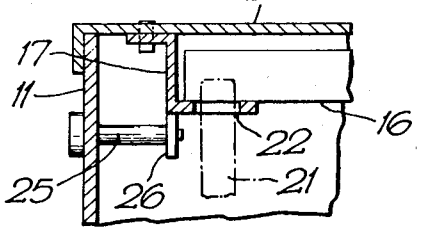
FIG. 3 is a cross-section through part of the cassette.

In addition to having the upper shutter 16, the lid 12 itself can be opened, primarily when the cassette is used in a cash dispenser. Normally, however, the lid 12 is locked in the closed position by a locking mechanism comprising a pin 25 (FIGS. 2B and 3) extending from the side wall 11 to a flange 26 attached to the lower section 17D of the rail 17A. The lid is locked in its closed position by the engagement of a hook portion 55 of a rotatably mounted toothed segment of pinion 45 of the control assembly 30. This is shown in more detail in FIG. 5.

The control assembly 30 shown in FIGS. 5–8 controls the opening and closing of the upper shutter 16, the opening and closing of a front shutter 29, the locking of the lid 12 (as explained above) and the bias applied to a packer plate within the cassette (as explained in more detail below).

Figure 7:
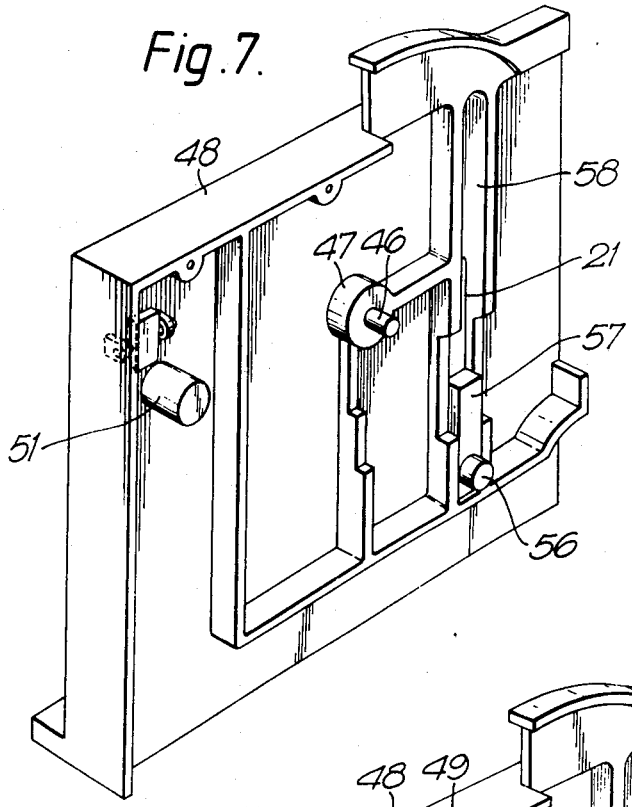
FIG. 7 is a view similar to FIG. 5 but with the further parts omitted.

As already mentioned, the control assembly 30 has a toothed segment 45 which is pivotally mounted to a plastics moulding 48 by a pin 46. The pin 46 is set into a boss 47 of the moulding 48, as seen in FIG. 7. A rack 70 is slidably mounted in a slot 71 of the moulding 48 and engages the teeth of a portion 72 of the segment 45. Movement of the rack 70 is controlled by a probe 73 mounted in the housing of the cash dispenser or cash acceptor into which the cassette is inserted, the probe 73 passing through an aperture 74 in the front end 27 of the cassette, the aperture 74 communicating with the slot 71.

The manner in which the probe 73 engages the rack 70 will now be explained. The rack 70 has a blind bore 180 and an aperture 181 passing through a wall of the bore 180.

Figure 14A:
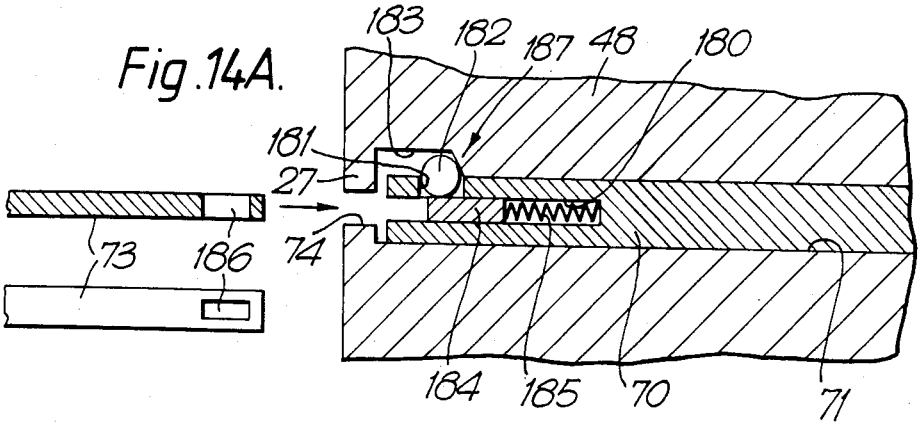

The rack 70 is locked in the position shown in FIG. 14A by a disc 182 which is received in a recess 183 of the slot 71 and protrudes into the aperture 181 of the rack 70. The disc 182 is prevented from passing through the aperture 181 by a plunger 184 slidably mounted in the bore 180 and biased towards the position shown in FIG. 14A by a compression spring 185. The rack 70 is prevented from moving to the left in FIG. 14A by part of the front wall 27 of the container 11.

Figure 14B:
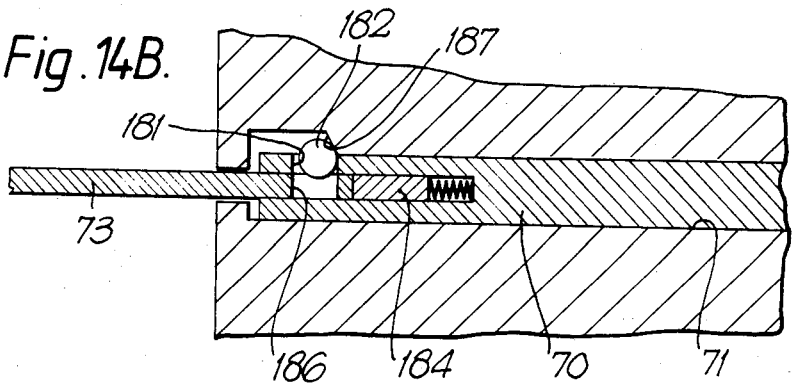
Figure 14C:
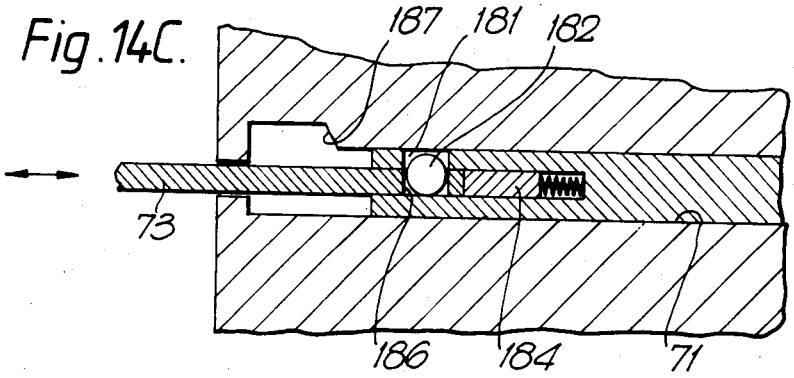

When the probe 73 enters the aperture 74 in the container 11 aligned with the rack 70, it enters into the bore 180 of the rack 70 and pushes the plunger 184 further into the bore against the spring action. This movement brings an aperture 186 in the probe 73 into alignment with the aperture 181 in the rack 70 as shown in FIG. 14B. Further movement of the cassette relative to the probe 73 causes the probe to push the rack 70 along the slot 71. This movement of the rack 70 acts on the disc 182 which cooperates with a cam face 187 on the moulding 48 and the wall of the aperture 181 to move into the apertures 181, 186 thus locking the probe and the rack together. Thereafter, as shown in FIG. 14C, the probe 10 can push the rack 70 (either directly or via movement of the cassette relative to the probe) or can pull it via the disc 182.

When the probe is withdrawn upon removal of the cassette, the rack 70 and probe 10 are drawn back to the position shown in FIG. 14B and since the probe is below the centre line of the disc 182, further movement of the probe 10, to the left in FIG. 14B, enables the disc 182 to ride the tip of the probe and so become squeezed out of its trapped position to resume the position shown in FIG. 14A. The plunger 184 follows the tip of the probe, under the influence of the spring 185, to regain its former position as shown in FIG. 1. In this situation, the rack 70 is again locked to the cassette by the disc 182.

It will be seen that coupling and uncoupling of the probe 73 and rack 70 is automatic and occurs in a continuous motion.

A similar connection is provided between the probe 67 and the rack 63.

As can be seen in FIG. 1, the front 27 of the cassette 10 is cut away to form an aperture 28 which is closed by a front shutter 29, the upper end 24 of the shutter 29 being located, in its closed position, under the skirt 16B of the upper shutter 16.

Figure 5:
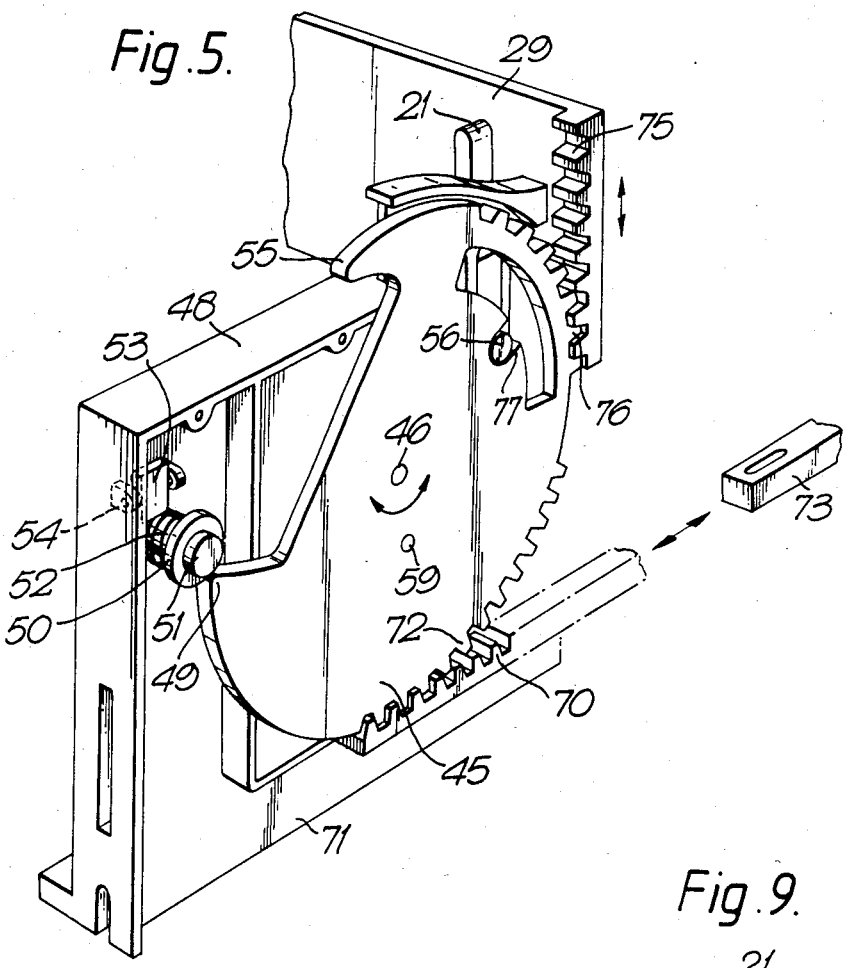
FIG. 5 is a perspective view of the front shutter control assembly with parts omitted for clarity.

Opposite sides of the shutter 29 are provided with respective racks 75 (one of which is shown in FIG. 5) which engage a toothed section 76 of the segment 45, and the pinion 64. It will be seen therefore that movement of the rack 70 within the slot 71 will cause the front shutter 29 to be driven downwardly, upon insertion of the probe 73, and upwardly upon withdrawal of the probe 73 due to the corresponding rotation of the segment 45.

Figure 9:
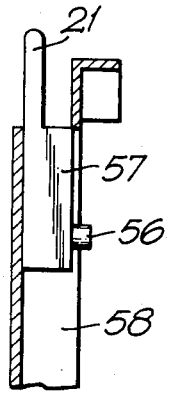
FIG. 9 illustrates the front shutter locking assembly in more detail.
Figure 8:
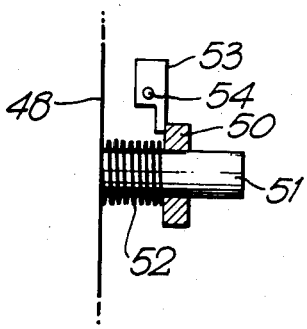
FIG. 8 illustrates the contactless lock of FIG. 5 in more detail.

The stop member 21 controlled by the assembly 30 is integrally formed with a slide member 57 (FIGS. 7 and 9), this unit being slidable within a slot 58 of the plastics moulding 48. The slide member 57 carries a pin 56 which is received in an aperture 77 formed in the segment 45. Thus, rotation of the segment 45 in an anti-clockwise direction, as seen in FIG. 5, will cause the pin 56 to be carried upwardly and hence the stop member 21 to be pushed upwardly along the slot 58 and out through the aperture 22 in the slide rail 17A. This anticlockwise rotation of the segment 45 will occur as the cassette is withdrawn and it should be noted that if the shutter 16 were kept in an open condition (pulled back) when the cassette was withdrawn, the stop member 21 would not be able to enter the aperture 22 due to its being blocked by the abutment 23 which will cover the aperture. Thus, removal of the cassette from the housing will not be possible. However, once the upper shutter 16 is correctly closed, the stop members 21 will protrude through the apertures 22 and the shutter 16 will be locked in its closed position.

The other stop member 21 is controlled in a similar manner by the pinion 64 of the control assembly.

Figure 6:
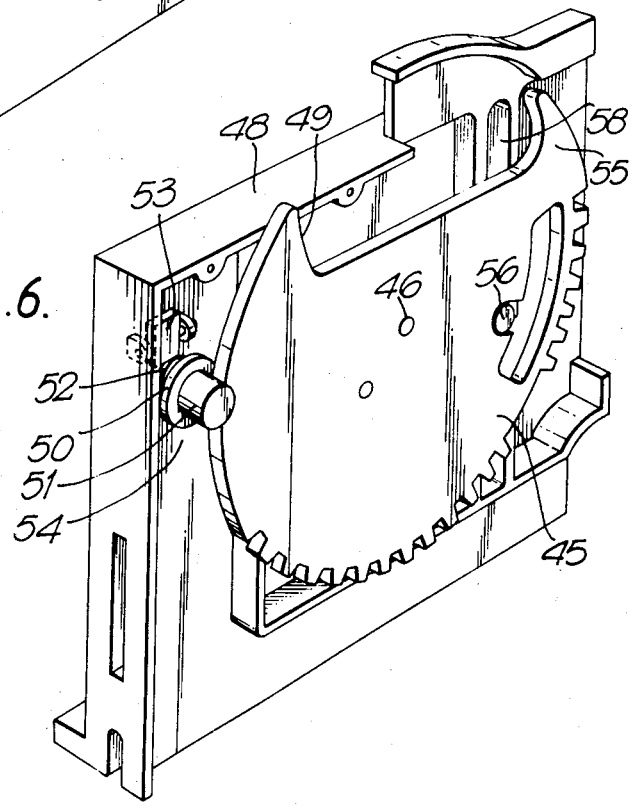
FIG. 6 is a view similar to FIG. 5 but with the control assembly in a different position.

The control assembly 30 is also provided with an auxiliary locking device to further prevent fraudulent operation of the control assembly by, for example, pushing a probe into the aperture 74 with the tamper-proof mechanism either rest or locked. This additional locking facility is provided by a contactless lock including a repulsion ring member 50 made of a conductive non-ferrous, non-magnetic material (such as copper) mounted on a soft iron core pin 51 set into the plastics moulding 48. In the locked position shown in FIG. 5, a surface 49 of the segment 45 engages the ring member 50 thus preventing clockwise rotation of the segment and hence downward, opening motion of the shutter 29. The ring 50 is urged towards its locked position shown in FIGS. 5 and 8 by a compression spring 52. Mounted behind a wall 171 (FIG. 1) of the cassette housing of the cash dispenser or cash acceptor into which the cassette is to be inserted, is an AC coil and soft iron core combination 78 positioned such that upon insertion of the cassette into the housing, the coil and core combination 78 when energised will repulse the ring member 50 away from it (due to eddy current affects), thus moving the ring member out of engagement with the surface 49. This then permits clockwise rotation of the segment 45 (FIG. 6). When the AC coil and iron core combination 78 is de-energised or the ring member moves out of the influence of the magnetic field produced by the combination 78, the ring member 50 tries to return to the position shown in FIG. 5 under the influence of spring 52. It is unable to resume this position when the segment 45 is rotated as in FIG. 6 and can only slide against the inner face of segment 45 until the condition shown in FIG. 5 is resumed, whereupon the ring 50 moves once again to block the rotation of segment 45 thus locking it in that position.

Note that it is not necessary to maintain excitation of AC coil 78 once the segment 45 is free and has begun to move.

In order that the contactless lock may not be overcome by a shock load, a balance member 53 is provided, pivoted to the plastics moulding 48 about an axis 54. The member 53 is arranged to balance the dead weight of the copper ring 50.

Figure 10:
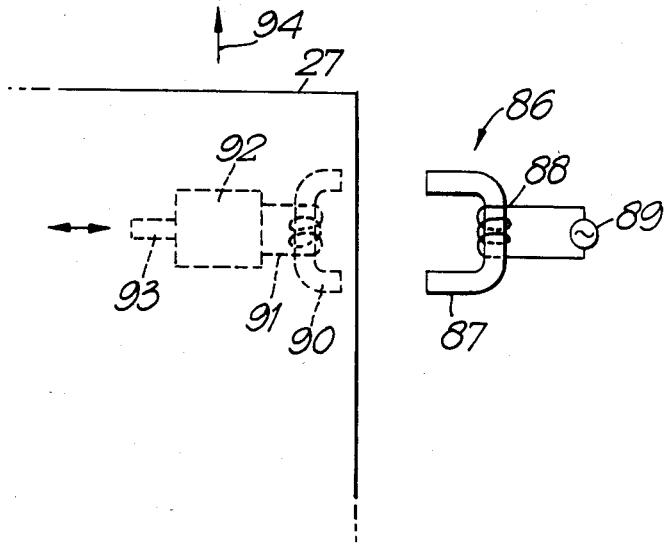
FIG. 10 illustrates schematically an alternative form of contactless lock.

An alternative form of a contactless lock is shown in FIG. 10 in which one half of a transformer 86 is provided in the cassette housing and comprises a U-shaped core 87 around which is provided a coil 88 connected to an AC source 89. The other half of the transformer is mounted within the plastics moulding 48 in place of the ring member 50 and core 51 and comprises a corresponding U-shaped core 90 around which is wound a coil 91 coupled to a solenoid 92. A plunger member 93 of the solenoid is urged in an axially outward direction from the solenoid by a compression spring (not shown) and is retracted from this locking position upon energisation of the solenoid 92. Such energisation will occur during insertion of the cassette into the cassette housing in the direction of the arrow 94 when sufficient flux couples from the core 87 into the core 90.

Figure 11:
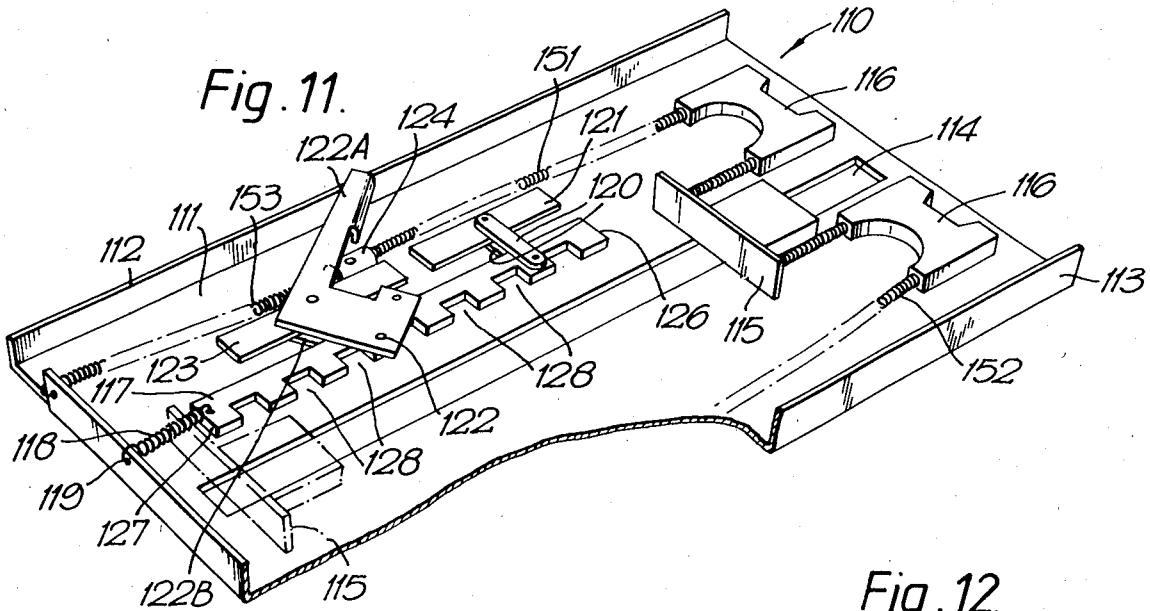
FIG. 11 is a partial plan of the underside of the floor of a cassette.

The cassette 10 has an inner floor 110, the underside of which is shown in FIG. 11. The floor 110 comprises a flat plate 111 which depending sides 112, 113. A slot 114 extends almost the whole length of the plate 111 and a carrier guide 115 is slidably mounted in the slot 114 for movement from the front of the cassette (full line position) to the back of the cassette (dotted line position). The carrier guide 115 carries a packer plate 150 (FIG. 1) on the upper surface of the floor 110, the packer plate 150 urging the stack of banknotes within the cassette towards the front of the cassette.

This urging of the packer plate 150 is achieved via the carrier guide 115 which is coupled to a pair of tension springs 151, 152. Spring 152 is made of relatively light gauge wire while spring 151 is made of relatively heavy gauge wire. The spring 151 extends around a guide 116 and is connected to a light gauge spring 153 by a spring connection 124. The light spring 153 is anchored at its end opposite from the connector 124 to the floor 110. The spring connector 124 is a cylindrical sleeve into which the looped ends of the springs 151, 153 are placed with a pin then being passed through the overlapping loops forming a rigid connection between the end of both springs and the cylinder. The pin passes through a hole drilled at right angles to the axis of the cylinder and lies flush with the outside wall being a tight fit within its hole.

The spring 152 extends around another guide 116 and is anchored to the cassette floor 110.

The spring 153 is of a lighter gauge of wire than the spring 151 and, in the position shown in FIG. 11, the force exerted on the carrier guide 115 is the combined effect of the total extension of both springs 151, 153, and the force exerted by the spring 152. The spring 152 is made of the same gauge of wire as the spring 153 so as to have a similar strength.

A packing plate locking bar 117 is supported on a pivot pin held between a pair of links 120 pivotally mounted to a bracket 121 fixed to the underside of the floor 110. The locking bar 117 is also pivotally connected at 122 between an actuating lever 122A and a backing plate 122B which themselves are pivoted to a bracket 123 fixed to the floor 110. The arrangement is such that the locking bar 117 is substantially parallel with the slot 114 and movement of the lever 122A about its pivotal connection to the bracket 123 will cause the locking bar 117 to move towards and away from the slot 114 while maintaining its parallel condition.

The locking bar 117 is biased towards a first position closest to the slot 114 by a tension spring 118 extending from the locking bar 117 to an anchorage 119 on the cassette floor 110. This first position is shown in FIG. 11.

In the position shown in FIG. 11, the lever 122A is in its released position in which the combined effects of the light springs 152, 153 and the heavy spring 151 are exerted on the carrier guide 115. In practice, the difference in gauge between the spring 151 and the spring 153 will be such that the spring 151 will act as a substantially rigid member. In this condition, a comparatively light force is exerted by the packer plate 150 against the stack of banknotes in the cassette, and this is suitable when the cassette is to be used in a cash dispensing operation.

Figure 12:
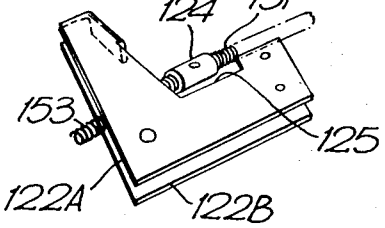
FIG. 12 illustrates the bias control lever in an alternative position.

In a cash accepting operation, the lever 122A is moved to the locked position shown in FIG. 12 in which the spring connector 124 is trapped in a notch 125 of the lever. In this position, the spring 153 will have no affect on the bias applied to the carrier guide 115 which will be influenced primarily by the heavy gauge spring 151. The packer plate 150 will therefore be urged under a comparatively heavy force against a stack of banknotes in the cassette.

When the locking bar 117 is in its locked position shown in FIG. 11, the carrier guide 115 may engage a leading end 126 of the locking bar or be received in respective castellations 128 along the length of the locking bar 117. This facility enables the packer plate to be restricted to one of a number of positions according to the amount of notes held in the cassette. This prevents the stack of notes from tipping over like dominoes from which position feeding of the notes would be impossible. This is needed in case the cassette is jolted during transit from one machine to another.

The packer plate can not move far enough to allow this to happen because of locking bar 117. If the cassette is completely full, the carrier guide 115 will be locked in position by engagement against a rear face 127 of the locking bar 117.

In practice, therefore, the lever 122A may take up one of three positions. Firstly, the position shown in FIG. 11 in which the locking bar 117 is in its locking position so as to engage the carrier guide 115, the connector 124 being released. In a second, intermediate position the lever 122A is rotated in an anticlockwise direction, as seen in FIG. 11, to withdraw the locking bar 117 from its locked position but to maintain the connector 124 released. Finally, in a third position, reached by further anti-clockwise rotation, the lever 122A will engage the connector 124 in the notch 125 and also maintain the locking bar 117 away from its locked position. It should be understood that the lever 122A can only move to this third position if the connector 124 is correctly positioned, and this will only occur when the cassette is empty and the carrier guide 115 positioned sufficiently near to the front of the cassette.

Figure 13:
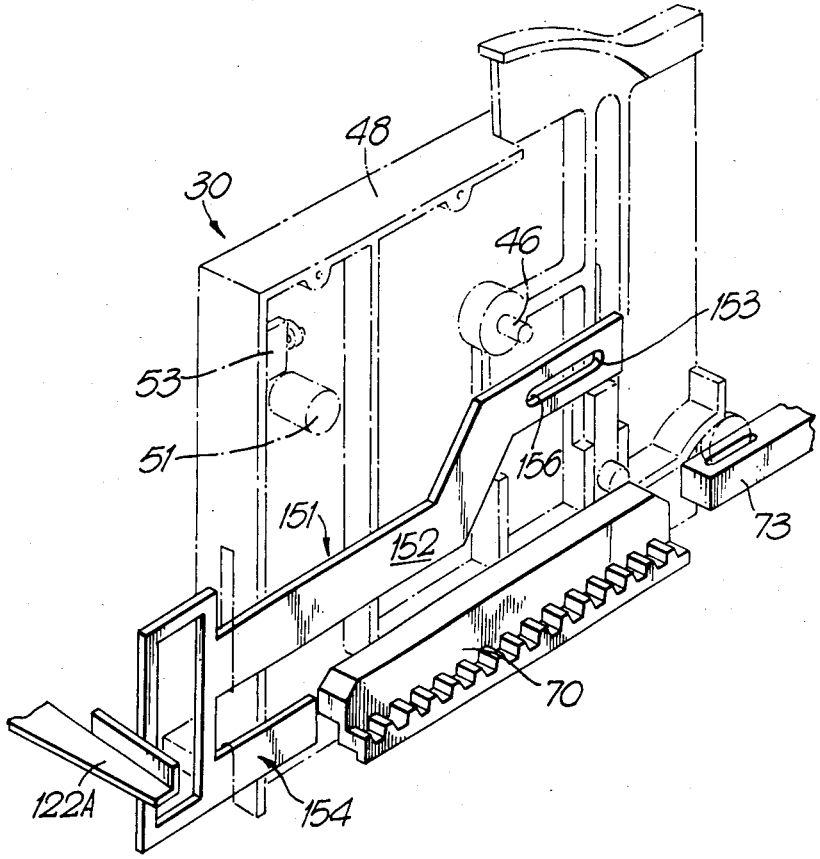
FIG. 13 illustrates those parts of the front shutter control assembly used for actuating the bias control lever; and, FIGS. 14A–14C are partial, schematic cross-sections illustrating the manner in which a probe and rack interlock.

FIG. 13 illustrates how the control assembly 30 actuates the lever 122A. FIG. 13 is similar to FIG. 5, but with most parts of the control assembly omitted for clarity or shown in dashed lines. The lever 122A engages a slide member 151 slidably mounted within the plastics moulding 48. The slide member 151 has a first arm 152 having at its end remote from the lever 122A a slot 153 in which is received a pin 59 mounted to the segment 45 (FIG. 5). The slide member 151 has a second arm 154 which extends a short distance in parallel with the arm 152 and in alignment with the rack 70.

The operation of the cassette in both a cash dispensing and a cash accepting mode will now be described.

CASH DISPENSING

In a cash dispensing mode, it is necessary for both the upper shutter 16 and front shutter 29 to be opened as and in some cases the lid 12 will also need to be raised slightly, while the packer plate must be urged against banknotes in the cassette under the light force due to the spring 153. Initially, the control assembly 31 is primed by turning a key in the lock 34, as previously explained. The cassette is then offered up to a cassette housing of a cash dispenser. This cash dispenser cassette housing has a pair of probes 67, 73 with a relatively short length and a pair of depending nudgers 155, 156 (FIG. 1) which engage the upper shutter 16. As the cassette is inserted, initially, the probes 67, 73 will enter the slots 68, 74 respectively, and engage and lock to respective racks 63, 70. Forward movement of the rack 63 will release the slide member 32 (as previously explained). In addition to this point the contactless lock will be released under the control of the coil/core combination 78 thus permitting further insertion of the probe 73 and sliding movement of the rack 70. This in turn will cause rotation of the segment 45 and the pinion 64 withdrawing the stop members 21 through the apertures 22, so that on further insertion of the cassette 10, the upper shutter 16 can be pushed rearwardly upon engagement with the nudgers 155, 156.

Just prior to engagement between the shutter 16 and the nudgers 155, 156, the segment 45 will begin to rotate due to movement of the rack 70 thus drawing the front shutter 29 downwardly and away from underneath the skirt 16B. Rotation of the segment 45 will also release the hook 55 from the pin 26 unlocking the lid 12. The cam 14 is received in the slot 170 in the side of the cassette housing, the slot being angled relative to the direction of insertion of the cassette so that the lid is pivoted about the hinge 13 away from the remainder of the cassette.

Initially, the leading end of the rack 70 is spaced from the trailing end of the arm 154 of the slide member 151, while the pin 59 on the segment 45 engages an end 156 of the slot 153. Thus, rotation of the segment 45 will immediately cause sliding movement of the slide member 151 so as to push the lever 122A from its first position, shown in FIG. 11, to its second, intermediate position in which the locking bar 117 is in its unlocked position while the connector 124 is released. At this point, the probes 67, 73 will be fully inserted into the slots 68, 74. Since the connector 124 is released, the packer plate will be urged under the light force against the stack of banknotes in the cassette which can then be withdrawn by the cash dispenser in a conventional manner. Typically, the cash dispenser will comprise a pair of rollers (not shown) which engage the leading note in the stack by extending through the aperture 28 in the front wall 27, sheets being extracted singly through the aperture 15. An example of such a dispenser is illustrated in EP-A-0161742.

After a dispense operation, the cassette is removed from the housing causing the racks 63, 70 to be pulled back to their initial positions, the lever 122A returning to its first position under the influence of the spring 119 and the front shutter 29 closing due to rotation of the segment 45 and pinion 64. In addition, the upper shutter will close under the influence of the spring 19 and the stop members 21 will return to the locking positions in which they protrude through their respective apertures 22 behind abutments 23. The locking bar 117 will lock the packer plate 115 in whichever position it has now reached.

CASH ACCEPTING

In a cash accepting mode, the cassette housing of a cash acceptor will be similar to that of the cash dispenser but with the following differences. Firstly no nudgers 155, 156 will be provided; secondly the probes 67, 73 will be longer than the probes of the cash dispenser; and thirdly the lid 12 will not be raised, although a slot will be provided in the housing to accommodate the cam 14, the slot extending generally parallel to the direction of insertion.

Initial operation of the cassette control assemblies 30, 31 will be similar to that of the cash dispenser with the front shutter 29 being lowered and the lever 122A being moved to its second, intermediate position. However, since the probes 67, 73 are longer than the probes of the cash dispenser, further insertion of the cassette into the cash acceptor housing, will cause further sliding movement of the racks 63, 70. This will be accompanied by rotation of the pinion 64 and segment 45 and although this extra motion in the cash accepting mode is only small, the movement of slide member 151 is continued not by pin 59 but by rack 70, which engages the second arm 154 of slide member 151. The motion of the rack 70 is faster than that of pin 59 because is it at a larger radius with respect to the pivot pin 46. Thus the end of rack 70 takes over from pin 59 and the slide 151 is pushed directly from the rack. Pin 59 meanwhile gets left behind in slot 153 as the slide 151 moves to the left.

In this way a second, substantial motion of lever 122A is possible, similar in stroke to its first motion although the extra rotation of segment 45 for cash accepting is much less than the initial rotation required for cash dispensing. The motion of slide 151 has been divided into two equal parts by changing from pin 59 to rack 70 as the prime mover.

The rack stays in engagement all the time, the shutter is opened further to expose the full extent of aperture 28 to provide an opening large enough for notes to be stuffed into the cassette.

This will move the lever 122A from its second, intermediate position to its third position in which the connector 124 is located within the notch 125. In this position, the carrier guide 115 is biased under the influence primarily of the spring 151 which causes a comparatively high force to be applied by the packer plate 150 against the stack of banknotes. It should be noted that further movement of the slide member 151 in this way is permitted by allowing the pin 59 to slide in the slot 153.

Typically, in a cash acceptor, the cassette is positioned vertically and banknotes are pushed through the aperture 28 into the cassette.

We claim:

1. A sheet store comprising a container defining an opening through which sheets can pass; a pressure member in said container; biasing means, said biasing means causing said pressure member to urge sheets in said container towards said opening and being adapted to apply one of two bias forces; and control means to control the bias force applied by said biasing means.

2. A store according to claim 1, wherein said biasing means comprises first and second bias portions connected in series, said first bias portion being coupled with said pressure member and said second bias portion being anchored to said container, said control means being adapted selectively to isolate said pressure member from the effect of said second bias portion.

3. A store according to claim 2, wherein said control means comprises a clamp which is selectively actuable to anchor part of said first bias portion remote from said pressure member and thereby to isolate said pressure member from the effect of said second bias portion.

4. A store according to claim 3, further comprising a connector coupling said first and second bias portions together, the clamp engaging said connector to anchor said first bias portion.

5. A store according to claim 3, wherein said clamp is pivoted to said container and has an arm for actuation by an operating member of a housing into which said store is loaded.

6. A store according to claim 2, wherein said first and second bias portions comprise springs.

7. A store according to claim 1, further comprising a pressure member locking device movable into engagement with a part of said pressure member to lock said pressure member against movement within said container.

8. A store according to claim 7, wherein said pressure member locking device is positioned under the control of said control means.

9. A store according to claim 8, wherein said control means comprises a clamp which is selectively actuable to anchor part of said first bias portion remote from said pressure member and thereby to isolate said pressure member from the effect of said second bias portion, and wherein said pressure member locking device is coupled to said clamp.

10. A store according to claim 9, wherein said claim is movable between three positions, a first position in which said first bias portion is not anchored and said pressure member locking device engages said part of said pressure member, a second position in which said pressure member locking device is disengaged from said pressure member and said first bias portion is not anchored, and a third position in which said first bias portion is anchored and said pressure member locking device is dis-engaged from said pressure member.

11. A store according to claim 1, further comprising a closure assembly including a shutter for closing said opening, and a locking device for locking said shutter in its closed position, said control means being actuable in one mode to maintain said locking device in a locked position and to cause one of said two bias forces to be applied to said pressure member and in another mode to release said locking device and to cause the other of said two bias forces to be applied to said pressure member.

12. A sheet dispensing and receiving system comprising sheet dispensing apparatus and sheet receiving apparatus including respective sheet store housings adapted to receive a sheet store comprising a container defining an opening through which sheets can pass; a pressure member in said container; biasing means, said biasing means causing said pressure member to urge sheets in said container towards said opening and being adapted to apply one of two bias forces; and control means to control the bias force applied by said biasing means, each sheet store housing including actuating means for actuating said control means of said sheet store, said actuating means cooperating with said control means such that when said sheet store is positioned in one of said housing said one bias force is applied to said pressure member and when said sheet store is positioned in the other of said housings the other bias force is applied to said pressure member.

* * * * *